US005726953A

United States Patent [19]

LaPointe et al.

[11] Patent Number: 5,726,953

[45] Date of Patent: Mar. 10, 1998

[54] ELECTROLUMINESCENT LAMP WITH BURIED INDICIAE AND METHOD FOR MAKING SAME

[75] Inventors: Bradley J. LaPointe, Shorewood, Minn.; David G. Sime, Boulder, Colo.

[73] Assignee: Metro-Mark, Incorporated, Minnetonka, Minn.

[21] Appl. No.: 645,917

[22] Filed: May 14, 1996

Related U.S. Application Data

[63] Continuation of Ser. No. 418,551, Apr. 7, 1995, abandoned.

[51] Int. Cl.[6] ..... G04B 19/30; G04C 17/00; G09F 13/22; H05B 33/02

[52] U.S. Cl. ..... 368/67; 368/226; 368/227; 368/239; 40/544; 313/502; 313/506; 313/510

[58] Field of Search ..... 368/82–84, 62, 368/239–242, 223, 226–228, 233, 234; 40/541–544; 313/498, 509, 513; 428/690; 445/350; 345/45, 76

[56] References Cited

U.S. PATENT DOCUMENTS

| | | | |
|---|---|---|---|
| 2,790,161 | 4/1957 | Joormann | 40/544 |
| 2,858,632 | 11/1958 | Caseris et al. | 40/544 |
| 3,003,305 | 10/1961 | Goldman | 40/544 |
| 3,083,317 | 3/1963 | Fish et al. | 40/544 |
| 3,680,237 | 8/1972 | Finnerty | 40/130 M |
| 4,138,620 | 2/1979 | Dickson | 313/1 |
| 4,513,023 | 4/1985 | Wary | 427/54.1 |
| 4,645,970 | 2/1987 | Murphy | 40/544 |
| 4,775,964 | 10/1988 | Alessio et al. | 368/67 |
| 4,999,936 | 3/1991 | Calamia et al. | 40/544 |
| 5,036,249 | 7/1991 | Pike | 313/509 |
| 5,265,071 | 11/1993 | Thorgersen | 368/67 |
| 5,276,382 | 1/1994 | Stocker et al. | 317/506 |
| 5,336,345 | 8/1994 | Gustafson et al. | 156/67 |
| 5,346,718 | 9/1994 | Thorgersen et al. | 427/66 |
| 5,410,207 | 4/1995 | LaPointe | 313/509 |

FOREIGN PATENT DOCUMENTS

| | | | |
|---|---|---|---|
| 4367892 | 6/1991 | Japan | 40/544 |
| 3192690 | 8/1991 | Japan | 40/544 |

*Primary Examiner*—Vit W. Miska
*Attorney, Agent, or Firm*—Thompson & Knight

[57] ABSTRACT

An electroluminescent ("EL") lamp has EL material sandwiched between front and back conductive layers, which are disposed on a transparent substrate. The indiciae are formed from ink or other material deposited on the second surface of the front conductive layer, thereby completely burying the indicia within the EL lamp. The material may be transparent or colored, conductive or insulating, or made with an EL phosphor. The buried indicia provide sufficient contrast, when viewed with the EL lamp in an illuminated or non-illuminated state, to be seen. The present invention also describes a method for fabrication of such EL lamps.

7 Claims, 1 Drawing Sheet

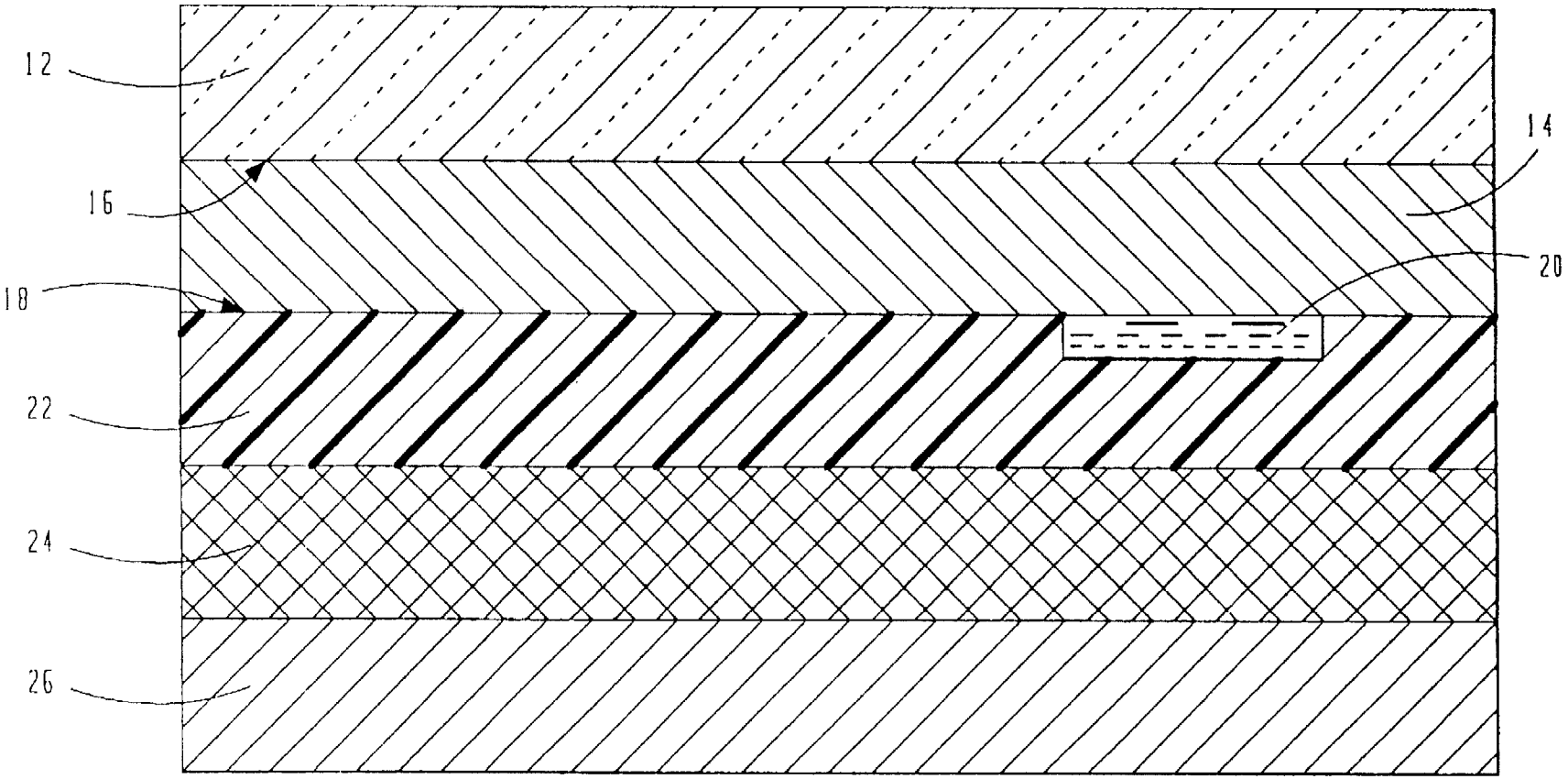
12
16
18
22
24
26
14
20

ELECTROLUMINESCENT LAMP WITH BURIED INDICIAE AND METHOD FOR MAKING SAME

This application is a continuation Ser. No. 08/418,551 filed Apr. 7, 1995, now abandoned.

TECHNICAL FIELD OF THE INVENTION

This invention relates generally to electroluminescent lamps wherein an indicating device, such as a meter display or dial, is illuminated by means of an electroluminescent lamp. This invention relates specifically to an electroluminescent lamp with buried indiciae and a method for making the same.

BACKGROUND OF THE INVENTION

Electroluminescent ("EL") lamps include a phosphor-bearing dielectric layer sandwiched between two electrodes. The front electrode is usually a transparent conductor such as indium tin oxide while the back electrode may be a non-transparent conductor. When the two electrodes are maintained at different potentials, the phosphor-bearing dielectric layer emits light which radiates through the transparent front electrode and provides a light source for the lamp.

Indiciae such as time-indicating numerals are typically printed or otherwise applied on the top or outside surface of the EL lamp. For example, U.S. Pat. No. 5,265,071 to Timex discloses a watch dial assembly wherein the indiciae are overprinted on the outer surface of the transparent substrate that bears, on its inside surface, a transparent electrode. The lamp, with the indiciae printed on the top surface of the outer surface of the transparent substrate, constitutes a single, integral unit that makes up the watch face.

Although the above-described EL lamp assemblies have been widely used, they are not entirely satisfactory. For example, damage may occur due to mechanical disruption during the manufacturing process, including scratching and scraping of the indiciae. In addition, there are problems associated with errors in manufacturing the EL lamps. In the prior art lamps, the indiciae are printed on the outside surface of the transparent substrate after completion of the lamp. At this stage of the manufacturing process, the lamp has a fairly high value. Accordingly, if an error is made in applying the indiciae, the entire lamp, with its high value, must be scrapped.

Thus, there is a need for an EL lamp with buried indiciae and a method for making the same that do not include the above-described disadvantages.

SUMMARY OF THE INVENTION

The present invention comprises an EL lamp with buried indiciae and a method for making the same that overcome the disadvantages associated with the prior art. An electroluminescent lamp with buried indiciae includes a polymer substrate; an electrically-conductive layer adhered to the polymer substrate; indiciae material deposited in a predetermined pattern on the second surface of the electrically-conductive material, said indiciae material being capable of providing sufficient contrast when viewed with the electroluminescent lamp in an illuminated or non-illuminated state; an electroluminescent layer deposited on the electrically-conductive layer and the indiciae material; an electrically-insulating layer deposited on the electroluminescent layer; and a second electrically-conductive layer deposited on the electrically-insulating layer.

A method for making an EL lamp according to the present invention comprises the steps of: providing a transparent substrate; depositing a first transparent, electrically-conductive layer on the transparent substrate forming a front electrode; depositing indiciae material in a predetermined pattern on the second surface of the front electrode; depositing an electroluminescent layer on said front electrode and indiciae material; depositing an electrically-insulating layer on the electroluminescent layer; and depositing a second conductive layer on the insulating layer forming a back electrode.

BRIEF DESCRIPTION OF THE DRAWING

For a more complete understanding of the present invention and the advantages thereof, reference is now made to the following Detailed Description of the Invention, taken in conjunction with the accompanying Drawing in which:

The sole FIGURE is a cross-sectional view of an EL lamp according to the present invention, illustrating the location of the indiciae on the underside of the transparent substrate.

DETAILED DESCRIPTION OF THE INVENTION

Referring now to the Drawing, there is shown a cross-sectional view of one embodiment of an EL lamp 10 according to the present invention. It will be appreciated that, although the use of buried indiciae in an EL lamp is the primary application of the present invention, it applies as well to other products wherein the use of buried indiciae is desirable, e.g., a watch face or dial structure. This invention may be used in applications wherein an indicating device containing graphical information, such as a meter display or dial, is illuminated by means of an electroluminescent lamp.

The EL lamp 10 of the present invention is manufactured in the manner and form of a conventional lamp with certain novel modifications. The EL lamp 10 may be fabricated by screen printing electrodes and multiple layers of architecture onto a polymer substrate 12. Although the invention will be described as constructed via a printing process, it will be appreciated that the EL lamp may be fabricated using other commercially available methods.

All of the internal major surfaces of the layers comprising the EL lamp 10 are disposed in parallel planes. Subsequent layers are stacked on previous layers via a printing process until an EL lamp according to the present invention has been fabricated. As constructed, the EL lamp 10 is essentially planar, when viewed in small cross-sections.

The Drawing is not made to scale. The layers of the EL lamp 10 have been greatly enlarged for the purpose of illustration, it being understood that some of the layers referred to herein are quite thin. In fact, the polymer substrate 12, together with layers 22–26, comprises a single, flexible EL lamp assembly that is very thin, i.e. approximately 0.15 to 0.2 mm.

The EL lamp 10 is formed on a polymer substrate 12. Preferably, the polymer substrate 12 is transparent and flexible. It is commercially available in the industry, e.g., under the brand name MYLAR.®

A transparent conductor is affixed to the polymer substrate 12 creating a front electrode 14. The front electrode consists of an electrically-conductive material, preferably indium tin oxide. The front electrode 14 has a first surface 16 and a second surface 18. The first surface 16 of the front electrode 14 is affixed to the polymer substrate 12. The polymer substrate may actually be prepared and purchased with the conductive layer applied, for example, from Southwall Corporation.

The front electrode 14 is co-extensive with the polymer substrate 12. In other words, the front electrode 14 overlays substantially the entire surface of the polymer substrate 12 on which it is deposited. In the EL lamp illustrated in the Drawing, all subsequently deposited layers (with the exception of the indiciae material 20 described below) have a similar co-extensive relationship with underlying layers of the EL lamp. This will not be true with every El lamp, however. Generally, the printed components of the lamp will locally exceed the indiciae in size.

Front electrode 14 is connected to a front electrode lead (not shown) for maintaining a predetermined potential across the front electrode 14.

Indiciae 20 are primed on or otherwise applied to the second surface 18 of the front electrode 14. As designed, the indiciae 20 are contained entirely within the envelope of the EL lamp structure, not printed on the outside surface of the polymer substrate 12. Material for forming the indiciae 20 is commercially available in the industry.

In the preferred embodiment, ink is used to form the indiciae for the lamp 10, however, other materials may be substituted for the ink, but the substituted material must be able to be handled as ink for purposes of printing or otherwise applying the indiciae. The selected material must also provide sufficient contrast, when viewed with the EL lamp in an illuminated or non-illuminated state, to be able to see the indiciae 20. For example, the material could be made visible by reflected light during the day and by transmitted light when the EL lamp is used in dark surroundings.

If ink is selected for forming the indiciae 20, it may be opaque or transparent. A conductive or insulating ink may also be used. Alternatively, the ink may be manufactured using an EL phosphor of a different color from the background, in accordance with known techniques.

If an insulating ink is selected, the indiciae 20 would remain darker when the EL layer was energized. The degree of darkness of the indiciae 20 would depend on the thickness of the printed layers of the EL lamp 10. A similar effect could be achieved using opaque indiciae.

If a conducting and transparent ink is selected, different colors could be used. Each color would become visible as it filtered the underlying EL light. In addition, various color combinations in both the indiciae and background could be created, providing design and functional flexibility.

After the indiciae 20 are applied to the second surface 18 of the front electrode 14, an electroluminescent layer 22 is added. The EL layer 22 is deposited on the first electrode 14 and the indiciae 20 so that it substantially overlies all of the first electrode 14 and the indiciae material 20. The EL layer 22 is composed of an EL material mixed with a polymeric binder. In the preferred embodiment, the EL layer 22 is formed from phosphor. Materials such as copper-activated or copper-manganese-activated zinc sulfide are suitable for the phosphor layer 22. Material for the EL layer is commercially available from Sylvania Corporation.

An electrically-insulating layer 24 is laid down over the phosphor layer 22. In the preferred embodiment, this dielectric layer 24 is formed from a material with a high dielectric constant K such as barium titanate. The dielectric layer 24 is an insulating layer, enabling higher potential to be maintained across the phosphor layer 22 to intensify its illumination. The dielectric layer 24 is co-extensive with the phosphor layer 22.

A second electrically-conductive layer is deposited on the dielectric layer 24, forming a back electrode 26. The back electrode 26 is co-extensive with the dielectric layer 24. The back electrode 26 is connected to a back electrode lead (not shown) for maintaining a predetermined potential across the back electrode 26 in a manner similar to the front electrode 14.

There are numerous advantages to an EL lamp fabricated according to the present invention. For example, since the indiciae 20 are buried within the EL lamp structure, they are protected from damage due to mechanical disruption that may occur with other EL lamps. In addition, the application of the indiciae 20 to the second surface 18 of the front electrode 14 occurs early in the manufacturing process, that is, immediately after the front electrode 14 has been deposited on the polymer substrate 12. Errors at this stage of the manufacturing process will not destroy the lamp 10. One can simply scrap the item, which has little value at this early stage, and begin again. In contrast, when the indiciae 20 are applied after completion of the EL lamp, any error that occurs requires that the entire lamp be scrapped, a costly result at this late stage in the manufacturing process.

Although a preferred embodiment of the present invention has been illustrated in the accompanying Drawing and described in the foregoing Detailed Description of the Invention, it will be appreciated by those skilled in the art that the invention is not limited to the embodiments disclosed, but is capable of numerous rearrangements, modifications and substitutions of pans and elements without departing from the true spirit of the invention.

I claim:

1. An electroluminescent lamp with buried indiciae, comprising:

a polymer substrate;

a front electrode comprising electrically-conductive material and having a first surface adhered to the polymer substrate;

electrically insulating EL phosphor indiciae material deposited in a predetermined pattern directly on a second surface of the front electrode, said indiciae material being capable of providing sufficient contrast when viewed with the electroluminescent lamp in an illuminated or non-illuminated state;

an electroluminescent layer deposited on the front electrode and the indiciae material;

an insulating layer comprising electrically-insulating material deposited on the electroluminescent layer; and a back electrode comprising electrically-conductive material deposited on the electrically-insulating layer.

2. The electroluminescent lamp of claim 1 wherein the indiciae material is opaque.

3. The electroluminescent lamp of claim 1 wherein the indiciae material is colored.

4. Method for fabricating an electroluminescent lamp with buried indiciae, comprising the steps of:

(a) providing a transparent substrate;

(b) depositing a first transparent, electrically-conductive layer on the transparent substrate forming a front electrode;

(c) depositing electrically insulating indiciae material in a predetermined pattern directly on the front electrode;

(d) depositing an electroluminescent layer on the front electrode and indiciae material;

(e) depositing an electrically-insulating layer on the electroluminescent layer; and (f) depositing a second conductive layer on the insulating layer forming a back electrode.

5. A method for fabricating an electroluminescent lamp with buried indiciae, comprising the steps of:

(a) providing a transparent substrate;

(b) adhering a transparent first electrically-conductive layer to the transparent substrate;

(c) depositing electrically-insulating indiciae material in a predetermined pattern directly on the first electrically-conductive layer;

(d) adhering an electroluminescent layer to the first electrically-conductive layer;

(e) adhering an insulating layer to the electroluminescent layer; and (f) adhering a second electrically-conducting layer to the electrically-insulating layer.

6. An electroluminescent lamp with buried indiciae, comprising:

a polymer substrate;

a front electrode comprising electrically-conductive material and having a first surface adhered to the polymer substrate;

electrically-conductive transparent indiciae material deposited in a predetermined pattern on a second surface of the front electrode, said indiciae material being capable of providing sufficient contrast when viewed with the electroluminescent lamp in an illuminated or non-illuminated state;

an electroluminescent layer deposited on the front electrode and the indiciae material;

an insulating layer comprising electrically-insulating material deposited on the electroluminescent layer; and a back electrode comprising electrically-conductive material deposited on the electrically-insulating layer.

7. An electroluminescent lamp with buried indiciae, comprising:

a transparent substrate;

a layer of transparent electrically-conductive material adhered to the transparent substrate to form a front electrode, the layer of transparent electrically-conductive material having in contact therewith, in a predetermined pattern, electrically-conducting transparent indiciae material;

an electroluminescent layer adhered to the front electrode;

an insulating layer comprising electrically-insulating material adhered to the electroluminescent layer; and a back electrode comprising electrically-conducting material adhered to the electrically-insulating layer.

* * * * *